US010405612B1

(12) United States Patent
Chan

(10) Patent No.: US 10,405,612 B1
(45) Date of Patent: Sep. 10, 2019

(54) STRAP ADJUSTMENT SYSTEM

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 16/136,651

(22) Filed: Sep. 20, 2018

(51) Int. Cl.
*A44B 11/12* (2006.01)
*B65D 63/10* (2006.01)

(52) U.S. Cl.
CPC ..... *A44B 11/12* (2013.01); *B65D 63/1027* (2013.01); *B65D 2563/107* (2013.01); *Y10T 24/21* (2015.01); *Y10T 24/2183* (2015.01)

(58) Field of Classification Search
CPC ..... Y10T 24/2183; Y10T 24/216; Y10T 24/2113; Y10T 24/2142; A44B 11/12; A44B 11/14; B65D 63/1027; B65D 2563/107; A43C 11/146
See application file for complete search history.

(56) References Cited

U.S. PATENT DOCUMENTS 8,220,117 B2 * 7/2012 Lovato ..... A44B 11/266 24/573.09
8,348,113 B2 * 1/2013 Huang ..... B60R 9/10 224/567
8,474,113 B2 * 7/2013 Badrenas Buscart ..... A44B 11/266 24/593.11
2011/0290840 A1 * 12/2011 Huang ..... B60R 9/10 224/539

* cited by examiner

*Primary Examiner* — Robert Sandy
*Assistant Examiner* — Michael S Lee
(74) *Attorney, Agent, or Firm* — Collard & Roe, P.C.

(57) ABSTRACT

An adjustment system has a housing, a cam lid and a ratchet strap. The housing has an elastic arm connected to each one of its side walls, a front opening and a rear opening. The cam lid is rotatably connected to the side walls of the housing, and has two elastic arms extending under the bottom surface, and a locking element disposed in an interior cavity of the cam lid. The cam lid locks the ratchet strap to the housing when the ratchet strap is fed through the housing and cam lid so that the locking element engages teeth on the ratchet strap. Pressing the elastic arms of the housing toward each other presses against the sides of the cam lid and causes the cam lid to rotate and release the locking element from the teeth of the ratchet strap.

13 Claims, 8 Drawing Sheets

STRAP ADJUSTMENT SYSTEM

BACKGROUND OF THE INVENTION

1. Field of the Invention

This invention relates to a system for adjusting the length of a strap connecting two articles together, or connecting two sides of the same article. In particular, the invention relates to a system having a ratchet adjustment device that can be used to incrementally adjust the length of the strap to a desired setting.

2. The Prior Art

Sliding adjustment buckles are often used to adjust the size of a hat or helmet, or to adjust features on clothing or bags. In a conventional sliding adjustment buckle such as shown in U.S. Pat. No. 8,474,113 to Badrenas Buscart, a long strap with a set of teeth is caused to pass through a main body, and when the strap arrives the desired position, the lock element of the main body can buckle the same and keep the strap in place. The lock element of the main body is movable, and a metal spring is generally used to move the position of the lock element. When a ratchet strap is to be withdrawn from the main body, the lock element needs to be pressed, such that the metal spring can change the position of the lock element of the main body. The lock element of the main body is separated from the ratchet of the long strap, such that the ratchet strap can be withdrawn.

This arrangement requires several separate pieces, as well as a metal spring. It would be desirable to form a secure ratchet system that does not require the use of metal springs, which can become deformed and/or disengaged over time.

SUMMARY OF THE INVENTION

It is therefore an object of the invention to provide a strap adjustment system that allows for incremental adjustment of the length of a strap in a simple and effective manner, without the use of metal springs.

This object is accomplished by an adjustment system comprising a housing, a cam lid and a ratchet strap. The housing has a bottom, two side walls, an elastic arm connected to each one of the side walls, a front opening and a rear opening. The cam lid is rotatably connected to the side walls of the housing, and has a top, a bottom, two side walls, an interior cavity, a front opening, a rear opening, two elastic arms extending under the bottom surface, and at least one locking element disposed in the interior cavity. The ratchet strap has an elongated body with a plurality of teeth disposed on one side thereof. The ratchet strap is fed through the openings in the front and rear of the housing and cam lid and the at least one locking element engages at least one tooth of the ratchet strap to lock the ratchet strap to the cam lid. The ratchet strap is released by pressing the elastic arms of the housing toward each other, which causes the elastic arms of the housing to press against the sides of the cam lid and rotate the cam lid. The elastic arms have a sloped contour, which slide against a correspondingly sloped contour on the sides of cam lid, to rotate the cam lid downward, which then compresses the elastic arms of the cam lid against the bottom of the housing. This moves the locking element out of engagement with the teeth of the ratchet strap and allows the strap to move freely within the housing and cam lid until the elastic arms are released. Then, the spring force of the compressed elastic arms of the cam lid force the cam lid back into its original locked position. The elastic arms of the housing and cam lid replace the need for a metal coil spring, and simplify the manufacturing and assembly of the adjustment system.

In order to attach the system to an article, there is at least one leg projecting from the bottom surface of the housing, and a back plate that is securable to the at least one leg, so that the housing can be secured to an element by inserting the at least one leg through a hole in the element and securing the back plate to the leg. Preferably, there are two legs, each connected to a singular back plate. In a preferred embodiment, the back plate is configured to be reversible, such that the at least one leg is securable at two different depths within the back plate. This allows the adjustment system to be used on fabrics of varying thicknesses.

In one embodiment, the teeth of the strap are triangular and the locking element comprises a triangular protrusion disposed on the bottom of the cam lid, the protrusion being configured to fit within two adjacent teeth of the strap and lock the strap in place. In particular, the teeth of the strap are shaped so that a front of each tooth forms an angle with a bottom of the strap that is smaller than an angle formed by a back of each tooth with the bottom of the strap, and wherein the locking element is formed with a smaller angle relative to the bottom of the cam lid on a front side and a larger angle relative to the bottom of the cam lid on a rear side so that the strap can be pulled through the housing and cam lid in a forward direction without locking, but rearward motion of the ratchet strap locks the strap to the cam lid.

The other end of the strap can be secured to the article in different ways. In one embodiment, a locking plate is disposed on the other end of the strap. This locking plate can be directly sewn to an article, or it can be equipped with at least one leg projecting below the locking plate, and a back plate configured for attachment to the at least one leg, such that the second end of the ratchet strap is connectable to an article by inserting the at least one leg through an opening in the article and attaching the back plate to the at least one leg.

The housing and cam lid can be equipped with guides for guiding the strap through in a smooth manner. In one embodiment, the guides are formed by protrusion extending from the top of the cam lid into the cavity, and another protrusion extending from the bottom of the housing. These protrusions slide along the sides and top of the ratchet strap to keep the ratchet strap properly aligned in the cam lid and housing.

In one embodiment, the cam lid is connected to the housing by a protrusion on each one of the side walls of the housing, and an aperture on each side wall of the cam lid. The protrusions extend through the apertures to rotatably connect the cam lid to the housing.

In another embodiment, there is an extension extending from a rear of the housing, the extension covering a portion of the ratchet strap that extends beyond the rear of the housing. A slot can run through the extension, so that the end of the ratchet strap is encased within the extension.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Referring now in detail to the drawings and, in particular, FIGS. 1-5 show the complete assembly of the adjustment system 100 according to the invention. Adjustment system 100 is formed from three main components: a housing 10, a cam lid 20, and a ratchet strap 30. Housing 10 and cam lid 20 serve to lock ratchet strap 30 in a desired position during use, which position can be adjusted by releasing cam lid 20 from ratchet strap 30. The individual components are shown separately in FIGS. 5-14.

Figure 8:
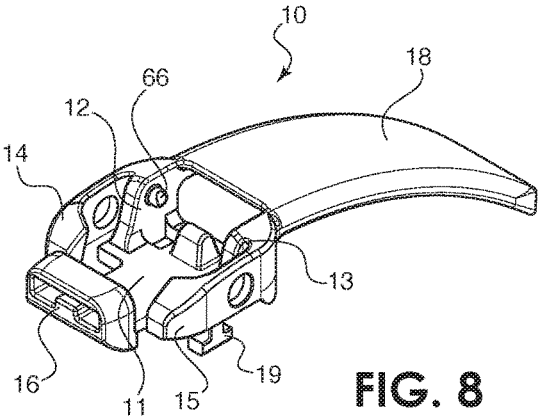
FIG. 8 shows a perspective view of the housing.
Figure 9:
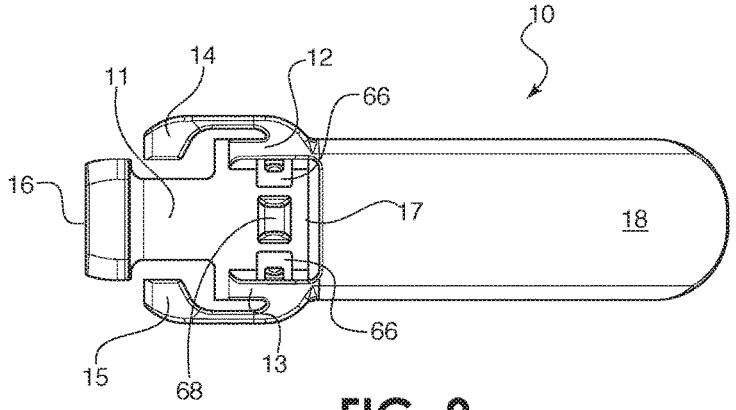
FIG. 9 shows a top view of the housing.
Figure 10:
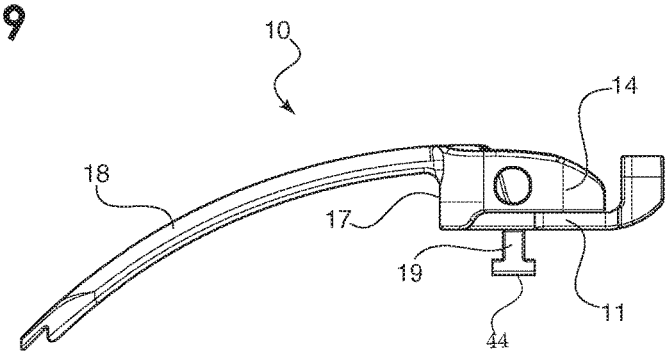
FIG. 10 shows a side view of the housing.
Figure 11:
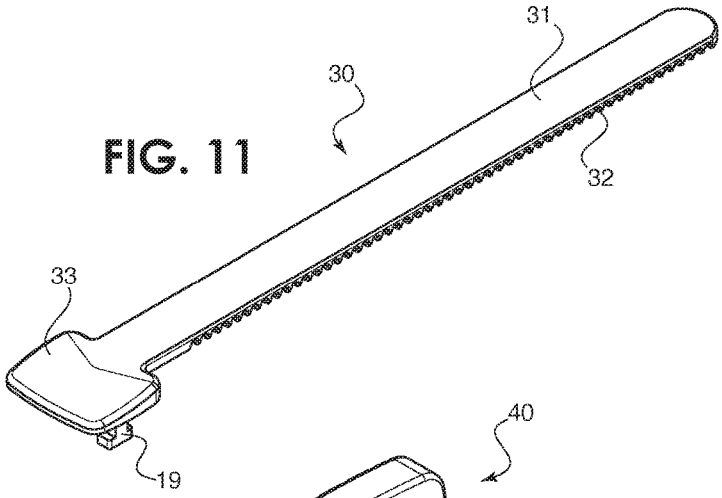
FIG. 11 shows a perspective view of one embodiment of the ratchet strap.
Figure 12:
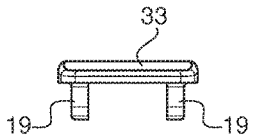
FIG. 12 shows an end view of the ratchet strap of FIG. 11.
Figure 13:
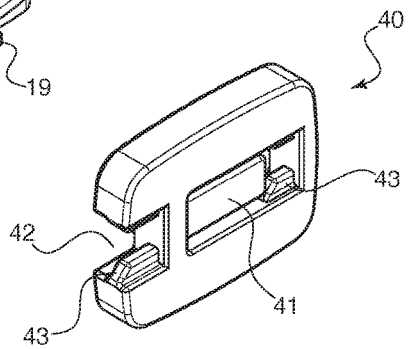
FIG. 13 shows a back plate for use with the ratchet strap of FIG. 11 and with the housing shown in FIGS. 1-5.

Starting with housing 10, as shown in FIGS. 8-10, housing 10 comprises a bottom 11, two side walls 12, 13, an elastic arm 14, 15 connected to each one of the side walls 12, 13, respectively, a front opening 16 and a rear opening 17. An extension 18 projects over the rear opening 17 to cover the ratchet strap when it extends through the rear opening 17. To connect housing 10 to an article, a pair of legs 19 extend from bottom 11. Legs 19 are connectable to a back plate 40, shown in FIGS. 13 and 14. Each of legs 19 has a locking tab 44 at its bottom end. The locking tab 44 on one leg can be inserted through slot 41 in back plate 40. Sliding the legs in a direction to the right shown in FIG. 13 causes locking tabs 44 to catch on retainers 43 to connect legs 19 to back plate 40. When legs 19 are inserted through an opening in an article, back plate 40 can be attached to legs 19 on the other side of the article to securely connect housing 10 to the article. As shown in FIG. 13, retainers 43 can be disposed offset within the thickness of back plate 40. This allows the system to be attached to articles of differing thicknesses by changing the orientation of back plate 40 relative to housing 10.

Cam lid 20 is rotatably connected to housing 10. Cam lid 20 is shown in detail in FIGS. 6 and 7. Cam lid 20 comprises a top 21, a bottom 22, two side walls 23, 24, an interior cavity 25, a front opening 26, a rear opening 27, two elastic arms 28, 29 extending under the bottom surface, and a pair of locking latches 77 disposed in the interior cavity for locking with the ratchet strap 30.

Figure 4:
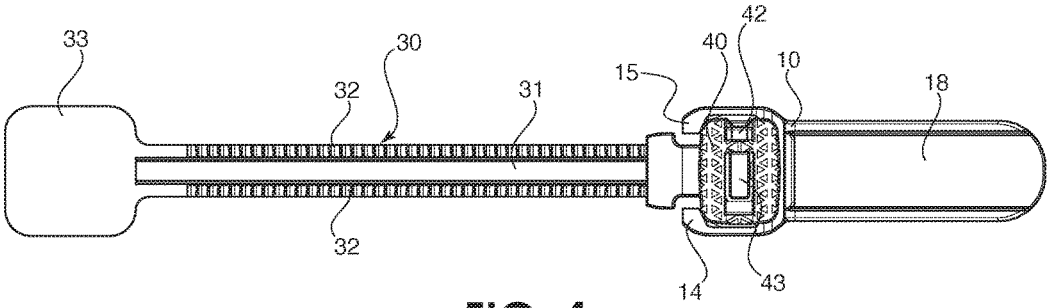
FIG. 4 shows a bottom view of the adjustment system.

Ratchet strap 30 is shown in detail in FIGS. 4 and 10. Ratchet strap 30 comprises a strap body 31 on which two rows of teeth 32 are arranged. Each tooth 32 is configured as a triangle having unequal sides, so that an angle between a front side and the strap body in a direction toward the housing 10 is smaller than an angle between the rear side and the strap body 31. This prevents the ratchet from being pulled backward out of the housing when strap 30 is inserted into the housing 10, but lets strap 30 be pushed in a forward direction more easily to shorten the length of the strap body in front of the housing.

Figure 1:
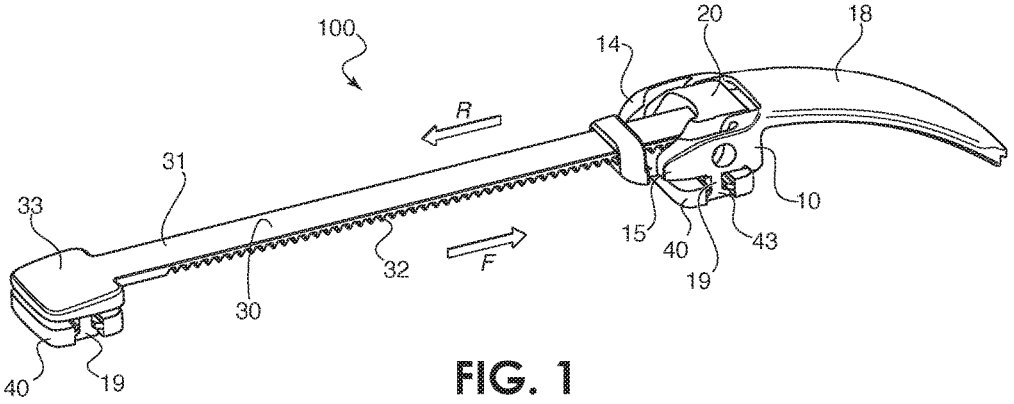
FIG. 1 shows a perspective view of one embodiment of the adjustment system according to the invention.
Figure 2:
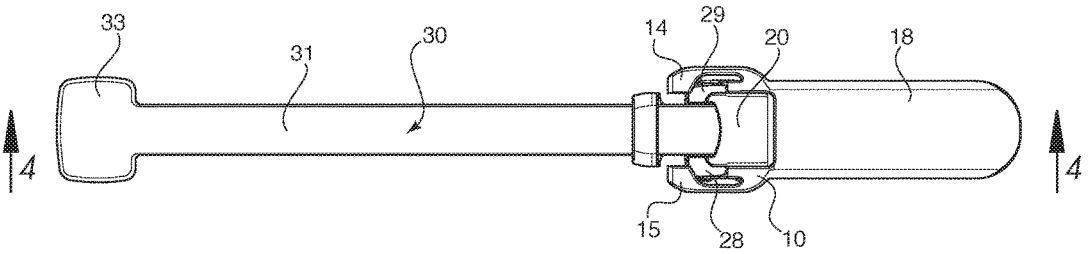
FIG. 2 shows a top view of the adjustment system.
Figure 3:
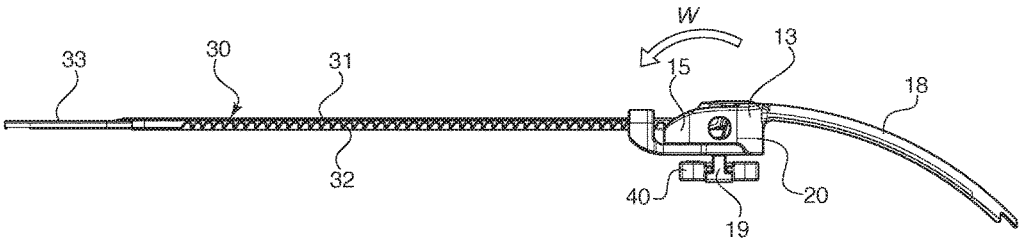
FIG. 3 shows a side view of the adjustment system.
Figure 14:
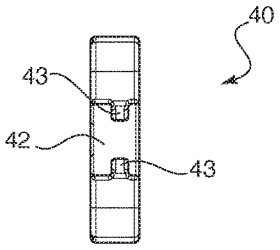
FIG. 14 shows an end view of the back plate of FIG. 13.
Figure 15:
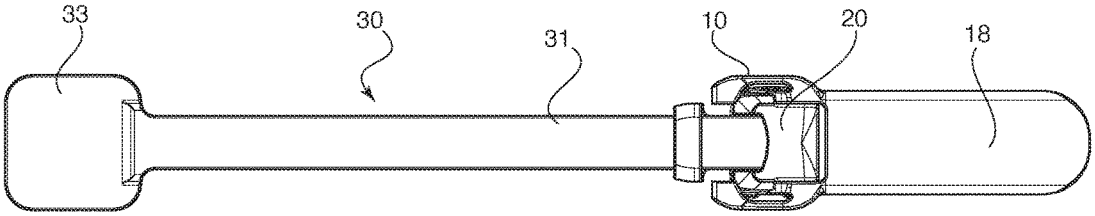
FIG. 15 shows a top view of the adjustment system using an alternative ratchet strap.
Figure 16:
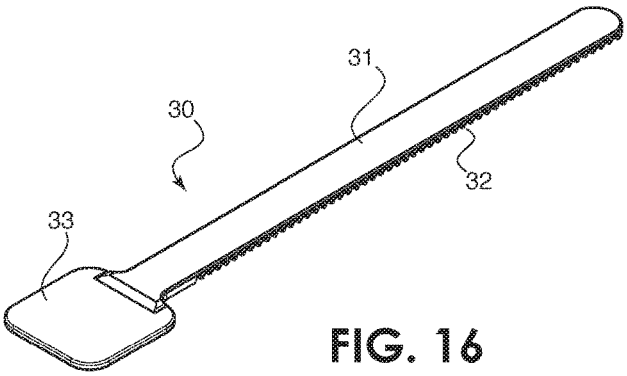
FIG. 16 shows a perspective view of the alternative ratchet strap.

The rear end of ratchet strap 30 has a locking plate 33, which can be configured with locking legs 19 in the same manner described above with respect to housing 10. Locking legs 19 can be locked to back plate 40 to attach ratchet strap 30 to an article in the same manner described above. Alternatively, locking plate 33 can be configured without legs, as shown in FIGS. 3, 14 and 15, and can be sewn directly to the article.

In use, the rear end of ratchet strap 30 is connected to an article by either legs 19 or by direct sewing, and housing 10 is also connected to the article (or another article) via legs 19 and back plate 40. Cam lid 20 is connected to housing 10 by placing protrusions 66 of housing 10 (shown in FIGS. 8 and 9) through apertures 67 in cam lid 20 (shown in FIGS. 6 and 7) to rotatably connect cam lid 20 to housing 10.

Figure 5:
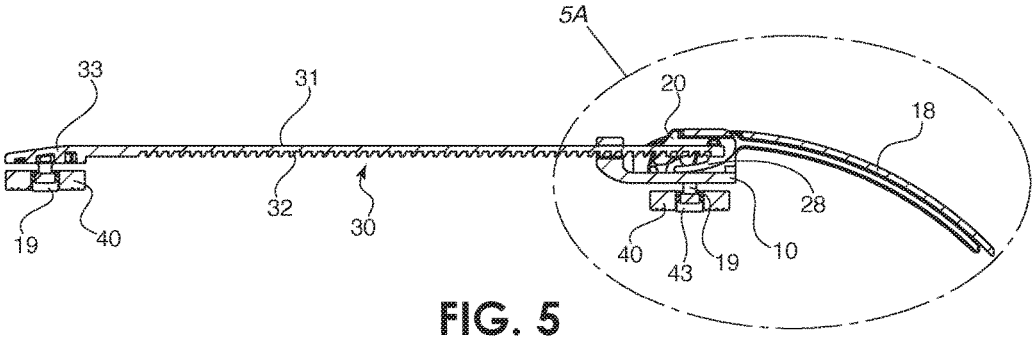
FIG. 5 shows a side cross-sectional view along lines 4-4 of FIG. 2.
Figure 5A:
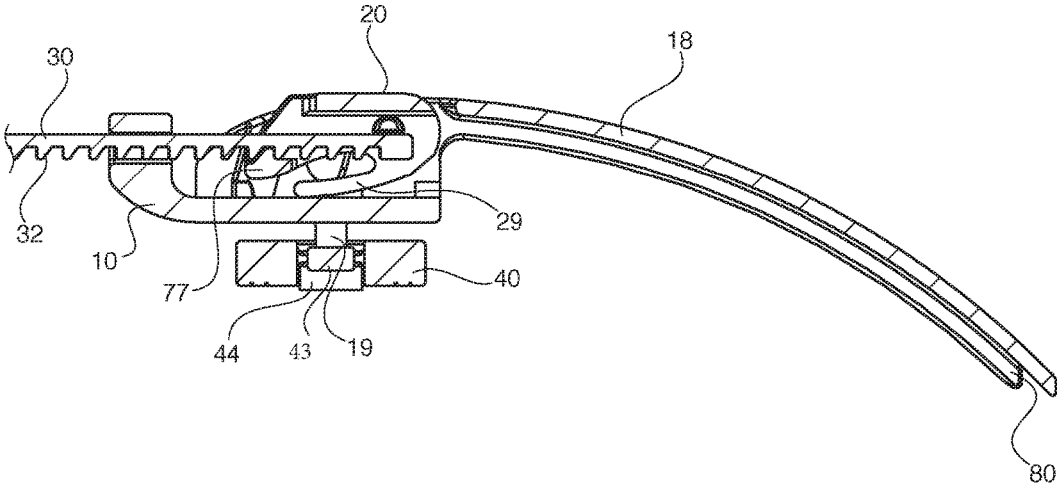
FIG. 5A is an enlargement of the housing and cam lid shown in FIG. 5.
Figure 6:
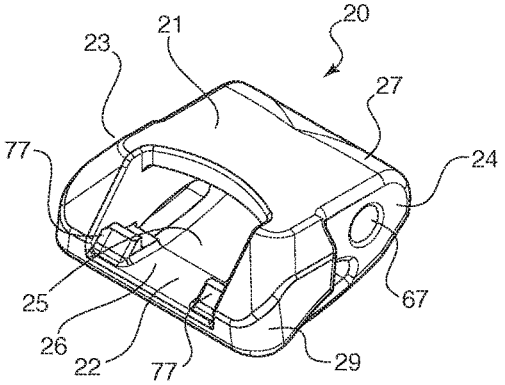
FIG. 6 shows a perspective view of the cam lid according to the invention.
Figure 7:
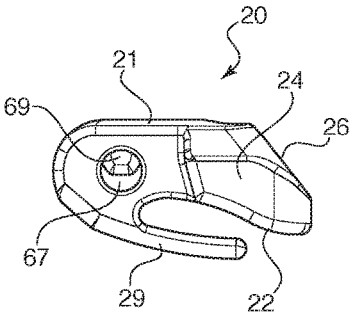
FIG. 7 shows a side view of the cam lid.

As shown in FIGS. 5 and 5A, the front end of ratchet strap 30 is then fed in through front opening 16 of housing 10 and front opening 26 of cam lid 20 until ratchet strap 30 is at a desired position. At this point, any rearward movement in direction R of ratchet strap 30 causes teeth 32 to catch on locking latches 77 of cam lid 20 and prevent any further rearward movement that would release ratchet strap 30 from housing 10. To keep ratchet strap 30 in proper alignment, an upward protrusion 68 is located on the bottom of housing 10 and downward protrusions 69 are located on the underside of cam lid 20. Upward protrusion 68 presses ratchet strap 30 against cam lid 20, and downward protrusions 69 keep ratchet strap 30 from sliding laterally within the space.

Any free end of ratchet strap 30 after adjustment exits through rear opening 17 of housing 10, and extends through slot 80 in extension 18.

Locking latches 77 are shaped to correspond to the space between teeth 32, so that teeth 32 become caught on locking latches 77 under any rearward pressure. The low angle of the front side of each tooth allows ratchet strap 30 to be adjusted in the forward direction F. The specific angle of teeth 32 can be seen enlarged in FIG. 5A.

To release ratchet strap 30 from housing 10, the user presses elastic arms 14, 15 toward each other. This causes elastic arms 14, 15 to slide against the sides of cam lid 20, forcing cam lid 20 to rotate in direction W as shown in FIG. 3. This rotation forces the front end of cam lid 20 downward, which releases locking latches 77 from teeth 32, which can then slide freely in both directions within housing 10. Releasing elastic legs 14, 15 of housing 10 causes cam lid to snap back to its original locking position due to the elastic nature of the arms 28, 29, which are pressed against the bottom of housing 10, to secure ratchet strap 30 in the desired adjustment position.

Accordingly, while only a few embodiments of the present invention have been shown and described, it is obvious that many changes and modifications may be made thereunto without departing from the spirit and scope of the invention.

What is claimed is:

1. An adjustment system comprising:

a housing having a bottom, two side walls, an elastic arm connected to each one of the side walls, a front opening and a rear opening, a cam lid rotatably connected to the side walls of the housing, the cam lid having a top, a bottom, two side walls, an interior cavity, a front opening, a rear opening, and at least one locking element disposed in the interior cavity, and a ratchet strap having an elongated body with a plurality of teeth disposed on one side thereof, wherein the cam lid is configured to lock the ratchet strap to the housing when the ratchet strap is fed through the openings in the front and rear of the housing and cam lid such that the at least one locking element engages at least one tooth of the ratchet strap, and wherein pressing the elastic arms of the housing toward each other causes the elastic arms of the housing to press against the sides of the cam lid and rotate the cam lid to release the at least one locking element from the at least one tooth of the ratchet strap.

2. The adjustment system according to claim 1, wherein the cam lid further comprises two elastic arms extending under the bottom of the cam lid, wherein pressing the elastic arms of the housing toward each other causes the elastic arms of the cam lid to be compressed against the bottom of the housing, and wherein releasing the elastic arms of the housing releases the elastic arms of the cam lid which rotates the cam lid back to a resting position.

3. The adjustment system according to claim 1, further comprising at least one leg projecting from the bottom surface of the housing, and a back plate that is securable to the at least one leg, so that the housing can be secured to an element by inserting the at least one leg through a hole in the element and securing the back plate to the leg.

4. The adjustment system according to claim 3, wherein the back plate is configured such that the at least one leg is securable at two different depths within the back plate.

5. The adjustment system according to claim 1, wherein the teeth of the strap are triangular and the at least one locking element comprises a triangular protrusion disposed on the bottom of the cam lid, the protrusion being configured to fit within two adjacent teeth of the strap and lock the strap in place.

6. The adjustment system according to claim 1, wherein a first end of the strap is lockable in the housing and further comprising a locking plate disposed at a second end of the strap.

7. The adjustment system according to claim 6, further comprising at least one leg projecting below the locking plate, and a back plate configured for attachment to the at least one leg, such that the second end of the ratchet strap is connectable to an article by inserting the at least one leg through an opening in the article and attaching the back plate to the at least one leg.

8. The adjustment system according to claim 1, further comprising a protrusion on each one of the side walls of the housing, and an aperture on each side wall of the cam lid, wherein the protrusions extend through the apertures to connect the cam lid to the housing.

9. The adjustment system according to claim 1, further comprising an extension extending from a rear of the housing, the extension covering a portion of the ratchet strap that extends beyond the rear of the housing.

10. The adjustment system according to claim 9, wherein the extension has a slot therethrough, and wherein the ratchet strap extends through the slot to be encased by the extension.

11. The adjustment system according to claim 1, further comprising a protrusion extending from the top of the cam lid into the cavity, and another protrusion extending from the bottom of the housing, the protrusions forming guides for the ratchet strap.

12. The adjustment system according to claim 3, wherein there are two of said legs projecting from the bottom of the housing.

13. The adjustment system according to claim 1, wherein the teeth of the strap are shaped so that a front of each tooth forms an angle with a bottom of the strap that is smaller than an angle formed by a back of each tooth with the bottom of the strap, and wherein the locking element is formed with a smaller angle relative to the bottom of the cam lid on a front side and a larger angle relative to the bottom of the cam lid on a rear side so that the strap can be pulled through the housing and cam lid in a forward direction without locking, but rearward motion of the ratchet strap locks the strap to the cam lid.

* * * * *